US005224464A

United States Patent [19]

Burnham et al.

[11] Patent Number: 5,224,464

[45] Date of Patent: Jul. 6, 1993

[54] TOY ARCHERY SET

[75] Inventors: Richard T. Burnham, Walpole; John Sutyak, Wakefield, both of Mass.

[73] Assignee: Tonka Corporation, Pawtucket, R.I.

[21] Appl. No.: 783,572

[22] Filed: Oct. 28, 1991

Related U.S. Application Data

[63] Continuation-in-part of Ser. No. 631,783, Dec. 21, 1990.

[51] Int. Cl.[5] ..... F41B 11/14; F41B 7/00; F41B 7/07

[52] U.S. Cl. ..... 124/67; 124/16

[58] Field of Search ..... 124/25, 23.1, 61, 66, 124/67, 65, 25.7, 64; 446/63-65, 180

[56] References Cited

U.S. PATENT DOCUMENTS

| | | | |
|---|---|---|---|
| 224,254 | 2/1880 | Warne | 124/25 X |
| 297,379 | 4/1884 | Gilman | 124/66 |
| 2,069,821 | 2/1937 | Douglas | 124/67 |
| 2,214,224 | 9/1940 | Douglas | 124/67 |
| 2,315,242 | 3/1943 | Briggs et al. | 124/65 X |
| 2,451,593 | 10/1948 | Washington, Jr. . | |
| 2,563,969 | 8/1951 | Skinner | 124/26 |
| 2,580,356 | 12/1951 | Martin | 124/66 |
| 2,725,869 | 12/1955 | Barber | 124/664 |
| 2,816,696 | 12/1957 | Stockfleth | 124/25.7 |
| 2,820,321 | 1/1958 | Kuhn | 446/63 |
| 2,991,782 | 7/1961 | Ayala | 124/65 |
| 3,077,876 | 2/1963 | Richter | 124/65 |
| 3,088,450 | 5/1963 | Clay | 124/26 |
| 3,148,478 | 9/1964 | Miller . | |
| 3,279,115 | 10/1966 | Worsham | 124/66 X |
| 3,561,418 | 2/1971 | Fredrickson | 124/25.5 X |
| 4,054,120 | 10/1977 | Foley | 124/62 |
| 4,076,006 | 2/1978 | Breslow et al. | 124/64 |
| 4,086,902 | 5/1978 | Reynolds | 124/61 |
| 4,212,285 | 7/1980 | Cagan et al. | 124/67 |
| 4,289,109 | 9/1981 | D'Andrade | 124/67 |
| 4,411,249 | 10/1983 | Fogarty et al. | 124/64 |
| 4,625,706 | 12/1986 | Turner, Jr. | 124/67 |
| 4,674,468 | 6/1987 | Izuta | 124/23.1 |
| 4,708,341 | 11/1987 | Paraskevakos | 124/67 X |
| 4,742,812 | 5/1988 | Goodman | 124/25 |
| 4,848,307 | 7/1989 | Tsao | 124/59 |
| 4,897,065 | 1/1990 | Fertig et al. | 446/63 |

*Primary Examiner*—Mickey Yu
*Attorney, Agent, or Firm*—Salter, Michaelson & Benson

[57] ABSTRACT

A toy archery set comprising a bow; a barrel rigidly attached to the bow; a movable plunger which has finger grooves and is longitudinally disposed within the barrel; a spring operably coupled to the plunger and to the barrel providing a projecting force either directly or through a pneumatic cylinder; and an arrow constructed of foam having fletching, a tip designed to adhere to a target, and a means to attach the arrow to the bow.

3 Claims, 5 Drawing Sheets

TOY ARCHERY SET

BACKGROUND OF THE INVENTION

This is a continuation-in-part of application Ser. No. 07/631,783 filed Dec. 21, 1990, pending. The present invention relates to toys and more particularly to toy archery sets.

Numerous toy archery sets have been known in the past. Typically, the archery sets use a bow as a means of projecting an arrow at a target. The bows for these toy archery sets are usually constructed of resilient wood or polymer material, and the arrows are usually constructed of a stiff, lightweight material. In the past, the arrow shaft has been constructed of stiff material so that the arrow would not compress or deform during shooting.

The arrow tips in toy archery sets are often made of suction cups or other devices which attach to a target but don't cause injury when striking a person. These arrow tips were sometimes removable from the arrow. The arrow, when shot without the tip, could become a dangerous projectile.

The force which projects the arrow in most archery sets, toy or otherwise, is caused by the resilient spring of the bow when the bowstring is released. Other toy archery sets employ an elastic material for the bowstring, projecting the arrow by the bowstring's elasticity. Both of these methods of projecting the arrow involve significant exposed forces which may be dangerous to children.

Typically, the bowstring is inserted into the nock of the arrow. The arrow must be carefully and properly held relative to the bow. For example, the arrow must be held so that the bowstring does not come out of the nock prior to shooting. Also, the arrow must be held at the proper point along the length of the bowstring. Further, the arrow must usually be held on the top of a handhold on the bow, so it does not fall away from the bow prior to shooting. The requirements for holding the arrow nock on the bowstring in the correct place, while the arrow rests on the handhold, add difficulty to shooting the arrow, especially for small children.

SUMMARY OF THE INVENTION

The present invention provides a safe and inexpensive toy archery set which is usable by young children. The bow includes a conventional spring, which may act on a pneumatic cylinder to provide the projecting force for the arrow. The projecting spring is enclosed so as to lessen the possibility of injury to a child using the toy archery set.

This invention also includes a specially designed arrow. The arrow, due to its shape, weight and material, is a safe projectile which can easily attached to the bow. Furthermore, the arrow can not easily be altered into a dangerous projectile. Therefore, a child can safely project the arrow with the bow. The present invention also includes a simple method of directing the arrow at the target.

In one preferred embodiment, the present invention includes an archery set which uses an enclosed cylindrical spring mechanism to provide the force which projects an arrow. Using any spring mechanism (e.g. cylindrical compression spring or expansion spring) rather than a resilient bow makes the operation of the device simpler. The spring is enclosed in a barrel assembly which is attached to the bow immediately above a handhold. By enclosing the spring used for the projective force, the bow is safer because a child using the bow is not exposed to the projective force. The bow and bowstring configuration can remain in the preferred embodiment for stability, aiming, and decorative use, even though it no longer provides the projective force for the arrow.

Also, in one preferred embodiment, the bow has a plunger which retracts to compress the spring and cock the arrow. The plunger may have a handle which makes retracting the plunger easy. The forward end of the plunger assembly can provide for releasable insertion into a central axial recess in the arrow. The central axial recess reduces the difficulty of cocking and aiming the arrow.

The plunger preferably includes a pneumatic piston disposed functionally between the conventional spring and the arrow. The spring drives the pump creating a pressurized air stream, which drives (i.e., projects) the arrow.

DETAILED DESCRIPTION OF THE PREFERRED EMBODIMENTS

Figure 1:
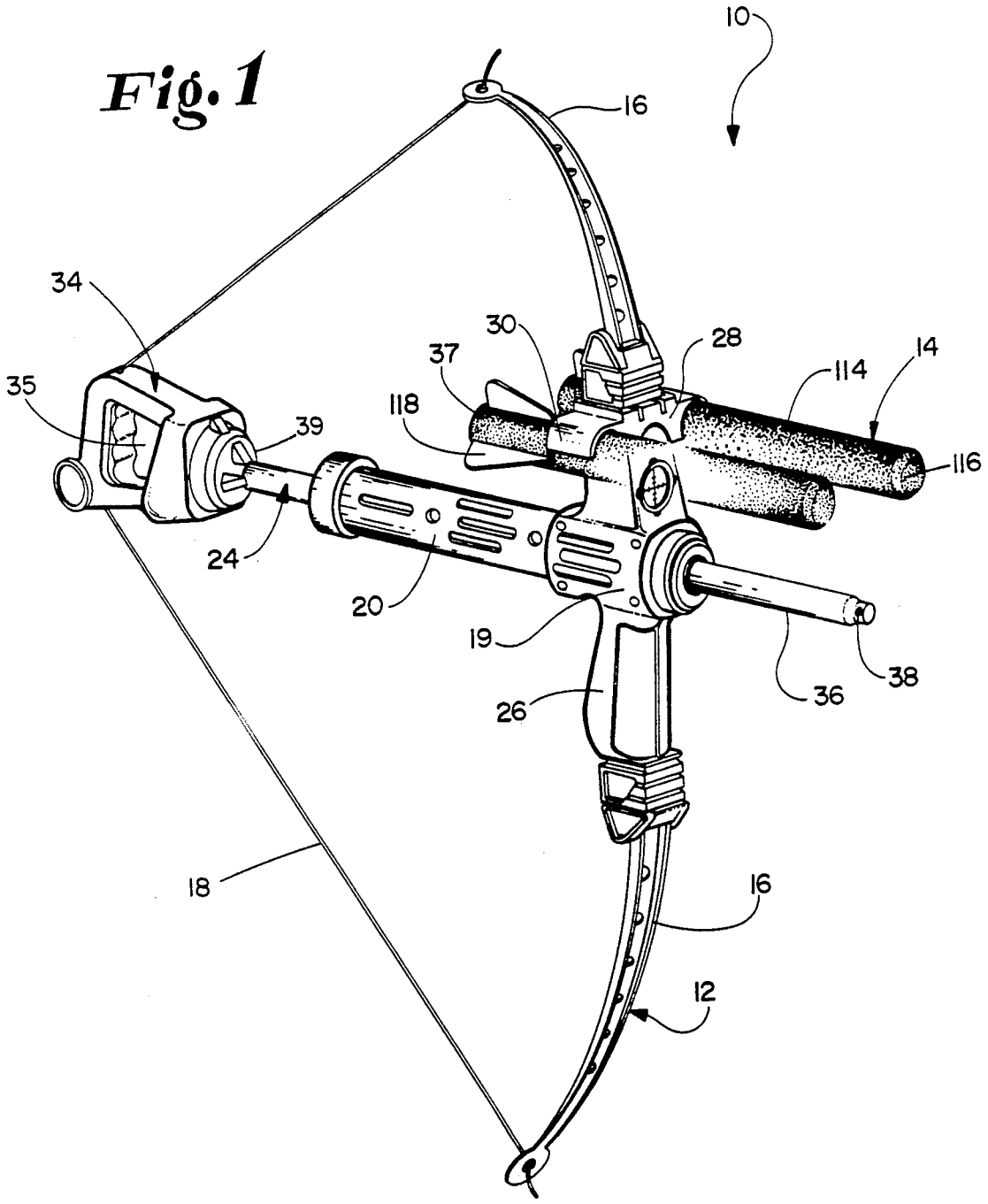
FIG. 1 shows a side perspective view of an archery set according to the present invention.

FIG. 1 shows a toy archery set 10 of the present invention which comprises a bow 12 and arrows 14. The bow 12 includes limb portions 16, a bowstring 18, barrel housing 19, a barrel 20, and a plunger 24.

The limb portions 16 are connected to, or integrally formed with the barrel housing 19. The connection between the limbs 16 and barrel housing 19 may be formed by interlocking the two pieces, by using pins, or by applying any other method known in the art. The exterior of the barrel housing 19 has a lower end formed as a handhold 26 suitable for being grasped by the user operating the bow 12. A quiver which may be a collet 28 may be mounted on the limb portions 16 on the barrel housing 19 or on any other appropriate portion of the bow 12. The collet 28 has two rings 30 and 32 (shown in FIG. 2), which are each sized to receive an arrow 14.

The limb portions 16 of the bow 12 are connected to bowstring 18. Plunger 24 has a handle 34 for drawing the bow 12. The handle 34 is grooved to receive bow string 18. The handle 34 may have finger grooves (not shown). The handle 34 may also have a hand opening 35. The bowstring 18 can be attached to handle 34 of the plunger 24. Rigid attachment of the bowstring 18 to handle 34 provides structural stability to the bow 12 through the plunger 24.

Proximal to the handle 34 is a shoulder portion 39. Shoulder portion 39 may be tapered distally. The forward movement of the plunger 24 (to be described later) may halt before the shoulder portion 39 touches the barrel 20. Either the tapering or preventing the shoulder portion 39 from touching the barrel 20 helps protect the user's fingers from being pinched. These two safety features are not necessary if the archery set is used properly.

The barrel housing 19 is attached perpendicularly to the approximate longitudinal center of the bow 12. Barrel 20 is coupled within housing 19 generally perpendicular to the length of the bow 12. The housing 19 and barrel 20 may be attached or integral with each other. An arrow support tip 36 is also coupled to housing 19 generally perpendicular to the length of the bow 12, and opposite barrel 20. Arrow support tip 36 is a generally cylindrically shaped tip, having an opening(s) 38 is its arrow-engaging end. The opening(s) 38 are directed sideward for safety purposes.

Arrows 14 have an axial bore formed within them. The axial bore has an opening at a bow-engaging end 37 of arrows 14. Arrow support tip 36 has a diameter which is approximately the same as the diameter of the axial bore in arrows 14. Therefore, an arrow 14 can be mounted on bow 12 for firing by having tip 36 inserted in the axial bore of an arrow 14.

During operation, an arrow 14 is mounted for firing on tip 36. The operator of bow 12 places one hand on handhold 26 and grasps handle 34 with the other hand. The operator pulls handle 34 away from housing 19, thus moving plunger 24 to its drawn position (shown in FIG. 1). When plunger 24 is drawn, it compresses a spring, encased in barrel 20. The operation of the spring mechanism will be described in more detail later in the specification. When the operator releases handle 34, the force of the compression spring urges plunger 24 into barrel 20. As a result, a compressed stream of air is forced through opening(s) 38 in tip 36, thereby propelling the arrow 14 mounted on tip 36. As a result, a compressed stream of air is forced through opening(s) 38 in tip 36. The air acts as a driving force on the arrow and as a lubricant between the arrow 14 and the support tip 36. The air also acts as a force to propel the arrow 14 mounted on tip 36.

Figure 2:
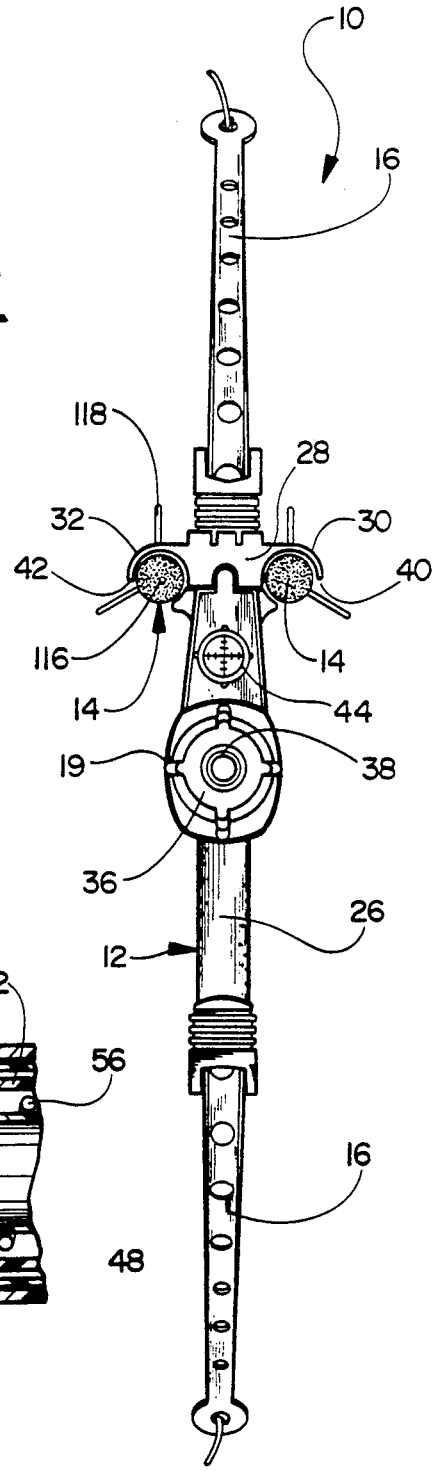
FIG. 2 is a front view of the bow shown in FIG. 1.

FIG. 2 shows a front view of archery set 10. The elements corresponding to those shown in FIG. 1 are correspondingly numbered. FIG. 2 more clearly shows the arrangement of collet 28 and rings 30 and 32. Rings 30 and 32 are generally semi-circular rings, having openings 40 and 42, respectively. Arrows 14 are formed, preferably, of a compressible, resilient material such as foam. Rings 30 and 32 each have an inner radius of curvature, which are sized to receive the arrows 14. Thus, arrows 14, when pressed into rings 30 and 32, are secured within the rings 30 and 32. FIG. 2 also shows a sight 44 formed in bow 12. In this preferred embodiment, sight 44 is a circular opening formed through the barrel housing 19 in bow 12. Sight 44 may include a clear plastic lens with cross-hairs, or it may simply be an opening. Bow string 18 can be used in alignment with sight 44 to aim bow 12.

Figure 3:
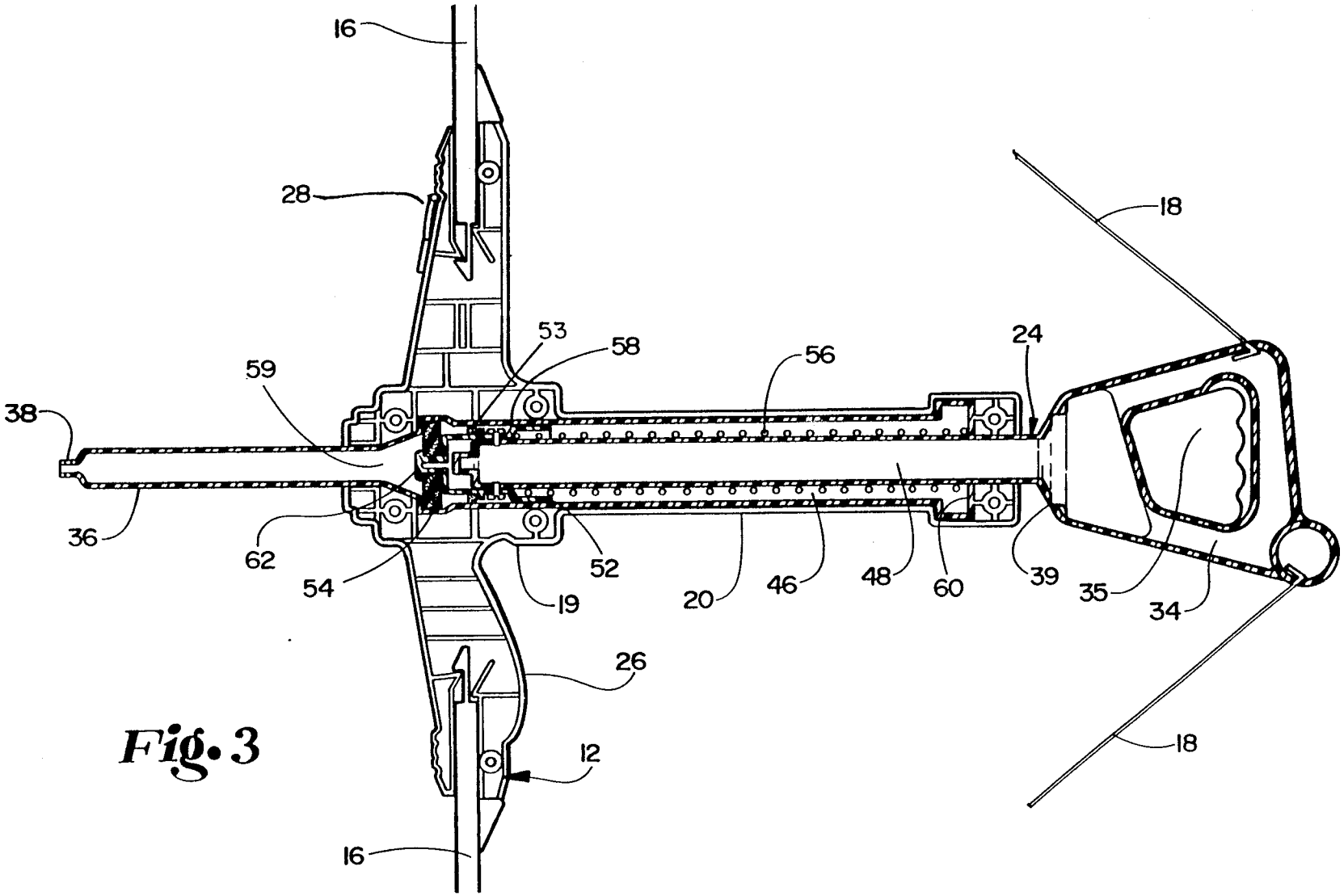
FIG. 3 is a partial side cross-sectional view of the bow shown in FIG. 1.

FIG. 3 shows a side sectional view of one preferred embodiment of bow 12. Some of the elements shown in FIG. 3 are similar to those shown in FIGS. 1 and 2. Similar elements are correspondingly numbered. FIG. 3 shows that barrel 20 defines a center opening 46. Plunger 24 has a shaft portion 48 that extends within center opening 46. Shaft portion 48 has a first end 50 which is attached to a collar 52. In turn, collar 52 has a opening for receiving a spring mechanism 56. Collar 52 is also attached to annular ring 54 and mounting post 62. Annular ring 54 may be cup-shaped, opening towards tip 36.

Spring mechanism 56 is inserted within collar 52 and rests against a shoulder 58 of collar 52. Spring mechanism 56 also rests against a back-spring stop 60 at the distal end of center opening 46. Shaft 48 of plunger 24 is rigidly attached to the collar 52 and to the annular ring 54. Therefore, when an operator draws bow 12 by pulling handle 34, and consequently plunger 24, away from barrel housing 19, collar 52 and annular ring 54 are also pulled away from barrel housing 19 within barrel 20. Therefore spring 56 is compressed between spring stop 60 and shoulder 58 on collar 52.

Arrow support tip 36 has a passage extending from opening(s) 38 to a base 59. The passage at base 59 opens into center opening 46 in barrel 20. Center opening 46 and base 59 can be formed by a plurality of tubular pieces being joined together or by one integrally formed tube extending from opening(s) 38 to spring stop 60.

Figure 4:
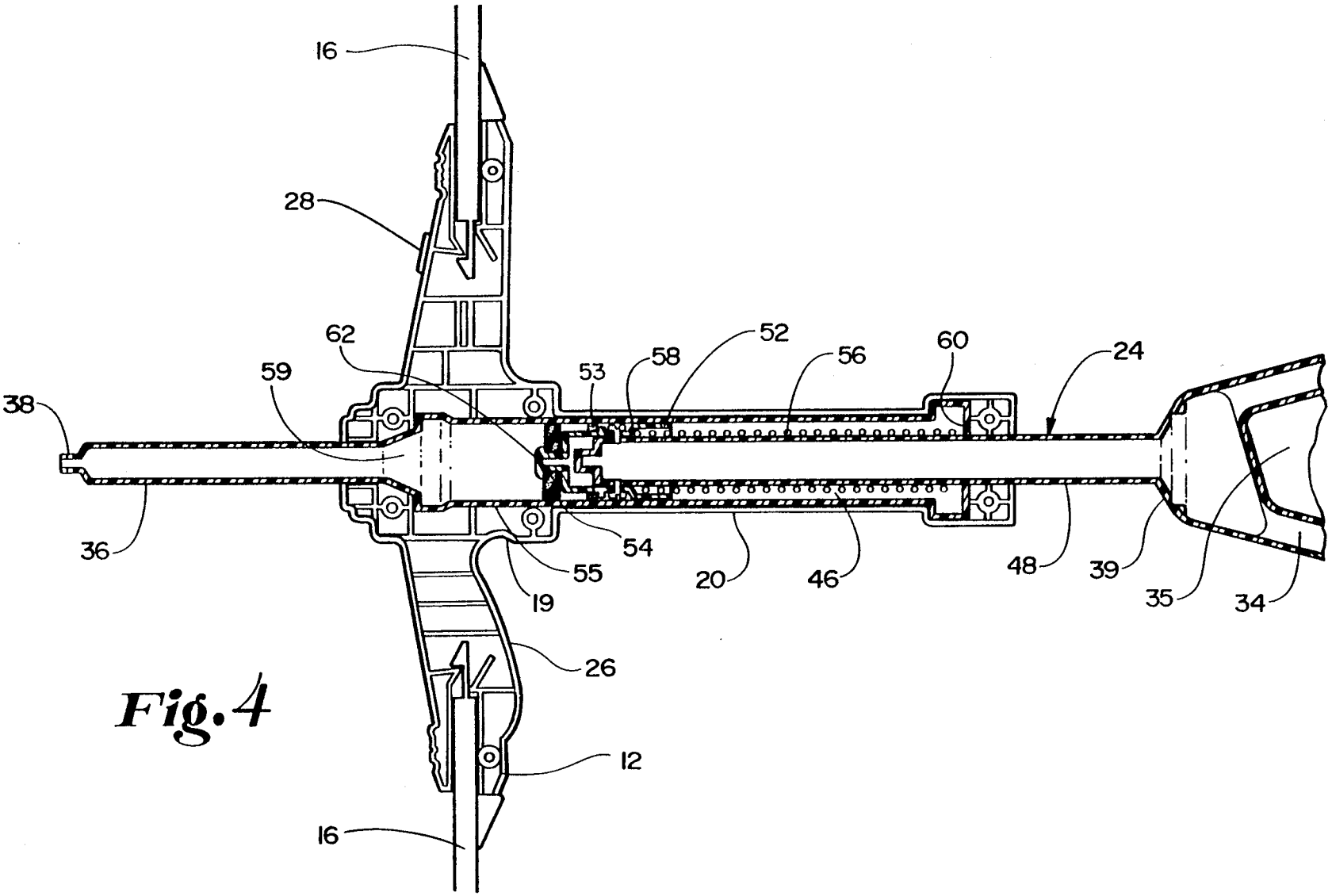
FIG. 4 is the cross-sectional view of the bow shown in FIG. 3 with the plunger in a partially drawn position.

FIG. 4 shows bow 12 in a partially drawn position. As the operator draws bow 12, spring 56 compresses, thereby applying a spring force to urge collar 52 and annular ring 54 back toward base 59. Annular ring 54 snugly abuts the inner surface 55 of barrel 20. Also, a central opening in annular ring 54 snugly receives mounting post 62 of collar 52. Therefore, the combination of annular ring 54 and mounting post 62 forms a substantially air tight barrier within barrel 20. The annular ring 54 helps draw air into the barrel 20 when the operator draws the bow 12.

When the operator releases handle 34, spring mechanism 56 expands, and pushing collar 52, as well as annular ring 54 and mounting post 62, towards base 59. Spring mechanism 56 exerts enough force so that this movement is quite rapid. Movement of this generally air tight barrier rapidly compresses air into a compressed air stream directed out through opening(s) 38 in tip 36. This air stream has enough velocity to propel an arrow 14 mounted on tip 36 into flight.

Figure 5:
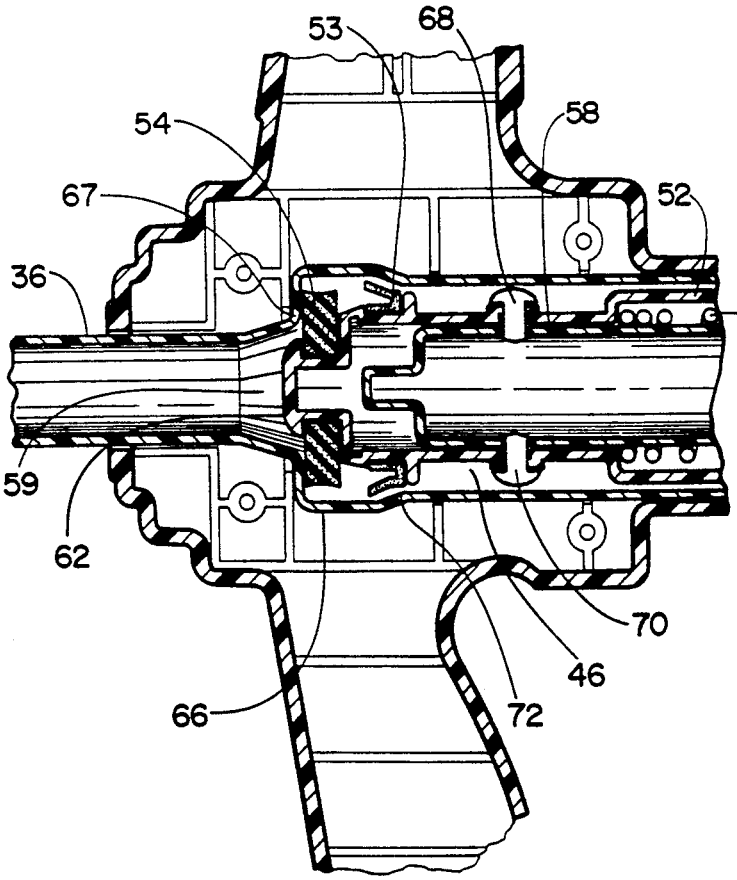
FIG. 5 is an enlarged cross-sectional view of a portion of the bow shown in FIG. 1.

FIG. 5 is an enlarged cross-sectional view of a portion of bow 12 wherein center opening 46 meets the base 59 of the tip 36. FIG. 5 shows that central opening 46 opens into a widened end 66 at shoulder 72. Annular ring 54 abuts the interior surface of the widened end 66 of center opening 46 and is urged against a stop 67. FIG. 5 also shows that collar 52 is attached to shaft 48 through the use of screws 68 and 70. Also, mounting post 62 is either frictionally fit into an opening in collar 52 or is formed integrally with collar 52. As the operator draws bow 12, annular ring 54 is pulled away from stop 67 in widened end 66 of center opening 46. The annular ring 54 moves backward past shoulder 72 into a narrower portion of center opening 46. Annular ring 54 is formed of a compressible, resilient material. Upon engaging shoulder 72, the annular ring 54 compresses to snugly fit the interior surface of barrel 20 along the narrow portion of center opening 46. The resilience of annular ring 54 assures that, when in the narrower portion of the center opening 46, annular ring 54 along with mounting post 62 forms the substantially air tight barrier in barrel 20 referred to with reference to FIG. 4.

Once the operator releases the handle 34 of the bow 12, compression spring 56 forces the air tight barrier back toward the widened end 66 and stop 67 in barrel 20. This causes an air stream to rush through barrel 20, into the bore in tip 36 and through opening(s) 38 until annular ring 54 comes to rest against stop 67. Thus, spring 56, along with annular ring 54, mounting post 62 and collar 52 essentially forms a pneumatic piston. Spring 56 provides the driving force for the pneumatic piston. The piston creates a pressurized air stream with enough force to drive an arrow 14 mounted on tip 36 into flight.

Figure 6:
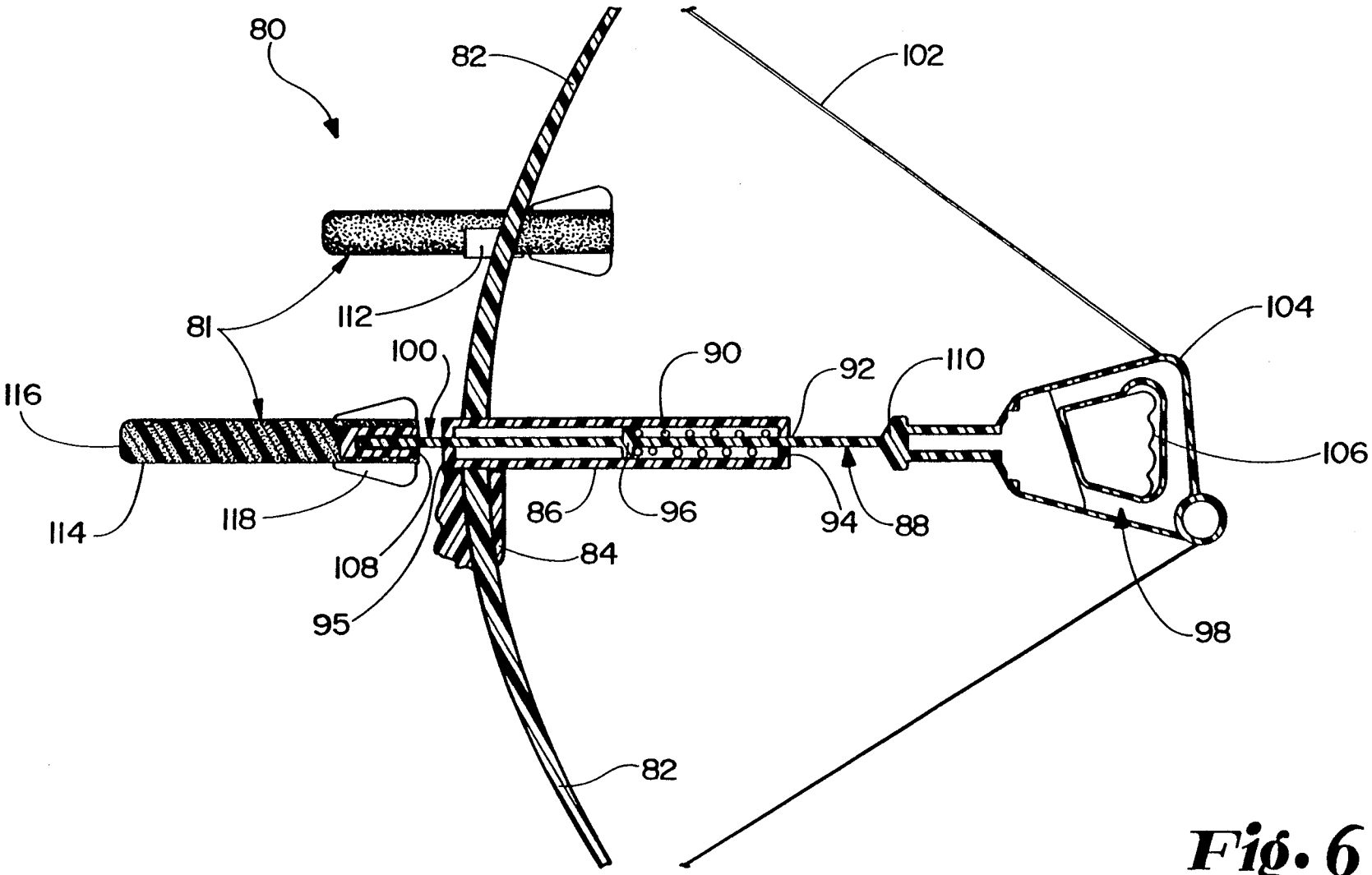
FIG. 6 is a side view of a second embodiment of a bow according to the present invention shown in partial cross-section.

FIG. 6 is a side view of a second embodiment of the present invention. In FIG. 6, a second bow 80 is shown with portions of bow 80 broken away. FIG. 6 also shows a portion of an arrow 81 broken away. Bow 80 includes limb portions 82, hand hold 84, barrel 86 and plunger 88. Plunger 88 includes compression spring 90, shaft 92, back-spring stop 94, front spring stop 96, handle end 98 and arrow engaging end 100. Bow 80 may also have at least one arrow engaging ring 112 for holding an arrow 81.

Bow string 102 is attached to limb portion 82 and may also be fixedly attached, through a handle 104 at handle end 98. Handle 104 includes a gripping portion which has finger grooves 106. Proximal to the handle 104 is a shoulder portion 110 which may taper distally.

During operation, the bow operator may draw bow 80 while gripping handle 104 and hand hold 84. The operator then draws handle 104 away from hand hold 84. Shaft 92 is slidably mounted within barrel 86. Therefore, when the operator draws bow 80, front spring stop 96 compression spring 90 against back-spring stop 94. Arrow engaging end 100 of plunger 88 includes an arrow plug 108 which fits snugly into an axial opening in arrow 81. Thus, when he operator releases handle 104, compression spring 90 acts on front spring stop 96 to urge handle 104 back toward hand hold 84. Handle 104 moves toward hand hold 84 quickly until the front spring stop 94 of the plunger 88 abuts a front spring stop 95 halting further movement before the shoulder portion 110 of plunger 88 abuts the back-spring stop 94. This causes plunger 88 to come to an abrupt halt. The momentum of the arrow 81 causes it to disengage from the arrow plug 108 and become airborne.

In the embodiments shown in FIGS. 1 and 6, arrows 14 and 81 are primarily formed int eh same (other than the axial bore of arrow 14 and axial opening of arrow 81). The arrows have a shank portion 114 formed of foam, or another appropriate soft, lightweight resilient material. Arrows 14 and 81 may alternatively have a tip portion 116 formed of a grasping material, such as hook and loop-type material, a magnet, or a suction cup.

Arrows 14 and 81 have blades 118 which are attached to shank 114 through the use of adhesive, heat welding, or another appropriate attachment means. The individual blades 118 collectively comprise the fletching. The distal end of the shank 114 may have grooves or recesses (not shown) designed to receive the blades 118. The blades 118 may be oriented such that the longitudinal axis of the shank 114 is in the longitudinal plane of the blades 118. Alternatively, the longitudinal access of the blades 118 may bisect the longitudinal axis of the shank 114. Preferably the blades 118 are equally spaced about the distal end of the shaft and formed integral with the shaft 114. Blades 118, which can be formed of foam, plastic, or another suitable material, guide the arrow 14 or 81 in a generally predictable flight path.

The present invention provides an archery set which substantially encloses the projective force used to project foam arrows. Further, the archery set of the present invention provides a projective force which does not rely on either the elasticity of the bow string or the resiliency of the bow itself. Therefore, operation of the bow is made significantly easier than operation of traditional archery sets which require a significant amount of coordination. The projective force can be provided by a number of suitable means including a spring mechanism, or a spring mechanism acting in conjunction with a pneumatic piston.

Although the present invention has been described with reference to preferred embodiments, workers skilled in the art will recognize that changes may be made in form and detail without departing from the spirit and scope of the invention.

What is claimed is:

1. A toy archery set comprising:

a bow;

bow sting means on said bow;

an elongated soft foam arrow;

a barrel rigidly secured to said bow and having a front end portion, the front end portion of said barrel being adapted for releasably securing said arrow thereto;

a plunger assembly including a plunger slidably received in said barrel an a plunger rod extending in a rearward direction from said plunger, said plunger rod being manually movable in said rearward direction for moving said plunger rearwardly in said barrel and being forwardly advanceable in said barrel for producing a compressed air stream which is transmitted to said arrow when said arrow is secured to said barrel front end portion in order to propel said arrow from said barrel in said forward direction;

spring biasing means in said barrel biasing said plunger in said forward direction;

said spring biasing means, said bow and said bow string means being constructed such that said spring provides substantially the entire forward biasing force applied to said plunger;

first handle means along said bow adjacent said barrel front end portion; and second handle means on said plunger rod for manually drawing said plunger rearwardly in said barrel and then releasing said plunger, said second handle means including a substantially rigid hand grip portion which is disposed in substantially transverse relation to said plunger rod and being adapted to be grasped by a hand of a user so that at least a portion of the fingers on the hand of said user at least partially encircle said hand grip portion;

said plunger being freely forwardly advanceable in said barrel upon releasing said second handle means.

2. In the toy archery set of claim 1, said second handle means substantially defining an opening, said hand grip portion extending along one side of said opening.

3. In the toy archery set of claim 2, said hand grip portion having finger grooves.

* * * * *

UNITED STATES PATENT AND TRADEMARK OFFICE

CERTIFICATE OF CORRECTION

PATENT NO. : 5,224,464

DATED : July 6, 1993

INVENTOR(S) : RAPAPPORT, Mark; and MA, Hansan

It is certified that error appears in the above-indentified patent and that said Letters Patent is hereby corrected as shown below:

Title page, item [75]

Change "Inventors: Richard T. Burnham, Walpole; John Sutyak, Wakefield, both of Mass."

to --Inventors: Mark Rapapport, Redondo Beach, Cal.; Hansan Ma, Marblehead, Mass.--

Signed and Sealed this

First Day of February, 1994

Bruce Lehman

*Attest:*

BRUCE LEHMAN

*Attesting Officer*

*Commissioner of Patents and Trademarks*